US006789798B1

(12) United States Patent
Adams et al.

(10) Patent No.: US 6,789,798 B1
(45) Date of Patent: Sep. 14, 2004

(54) GAME SYSTEM AND METHOD OF PLAYING

(76) Inventors: Jonathan Adams, P.O. Box 115, Oaklyn, NJ (US) 08107; Adriana Adams, P.O. Box 115, Oaklyn, NJ (US) 08107

( * ) Notice: Subject to any disclaimer, the term of this patent is extended or adjusted under 35 U.S.C. 154(b) by 0 days.

(21) Appl. No.: 10/436,486

(22) Filed: May 12, 2003

(51) Int. Cl.[7] ..... A63F 3/00
(52) U.S. Cl. ..... 273/239; 273/243; 273/287
(58) Field of Search ..... 273/239, 241, 273/283, 244, 287, 441, 443, 447, 448, 456, 243, 138.2; D21/342

(56) References Cited

U.S. PATENT DOCUMENTS 3,836,142 A 9/1974 Baker
4,214,755 A * 7/1980 Wysocki ..... 273/243
5,244,391 A * 9/1993 Bryant ..... 434/129
5,314,182 A 5/1994 Derr
5,513,848 A 5/1996 Keener
5,876,034 A * 3/1999 Stafford ..... 273/244

* cited by examiner

*Primary Examiner*—Vishu K. Mendiratta

(57) ABSTRACT

A game system and method of playing for entertaining a plurality of players. The game system and method of playing includes a game board. A playing path is positioned on the game board. The playing path is comprised of a plurality of play spaces. A plurality of player tokens are placed one the playing path for representing the place of the associated one of the players on the playing path. A fish containment assembly is operationally coupled to the game board. The fish containment assembly selectively contains a plurality of fish members. Each of a plurality of retrieval members is for retrieving one of the fish members from the fish containment assembly by one of the players when one of the player tokens of an associated one of the players is placed on a portion of the play spaces of the playing path.

19 Claims, 3 Drawing Sheets

GAME SYSTEM AND METHOD OF PLAYING

BACKGROUND OF THE INVENTION

1. Field of the Invention

The present invention relates to fishing board games and more particularly pertains to a new game system and method of playing for entertaining a plurality of players.

2. Description of the Prior Art

The use of fishing board games is known in the prior art. U.S. Pat. No. 5,513,848 describes a system for playing a game based off fishing. Another type of fishing board game is U.S. Pat. No. 3,836,142 having a magnetic game of skill to emulate fishing. U.S. Pat. No. 5,314,182 has a plurality of holes extending through a top level of the board game to allow players to use a hooking device to retrieve items in the board game through the holes similar to fishing.

SUMMARY OF THE INVENTION

An object of the present invention is to provide a new game system and method of playing that provides entertainment for a plurality of players.

Even still another object of the present invention is to provide a new game system and method of playing that tests the skill of the players to retrieve the fish members from the fish containment member.

To this end, the present invention generally comprises a game board being designed for being positioned on a support surface. A playing path is positioned on the game board. The playing path is comprised of a plurality of play spaces. A plurality of player tokens are placed one the playing path. Each of the players tokens is designed for being selected by one of the players whereby each of the player tokens is for representing the place of the associated one of the players on the playing path. A fish containment assembly is operationally coupled to the game board. The fish containment assembly selectively contains a plurality of fish members. Each of a plurality of retrieval members is designed for being gripped in a hand of the player. Each of the retrieval members is for retrieving one of the fish members from the fish containment assembly when one of the player tokens of an associated one of the players is placed on a portion of the play spaces of the playing path.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
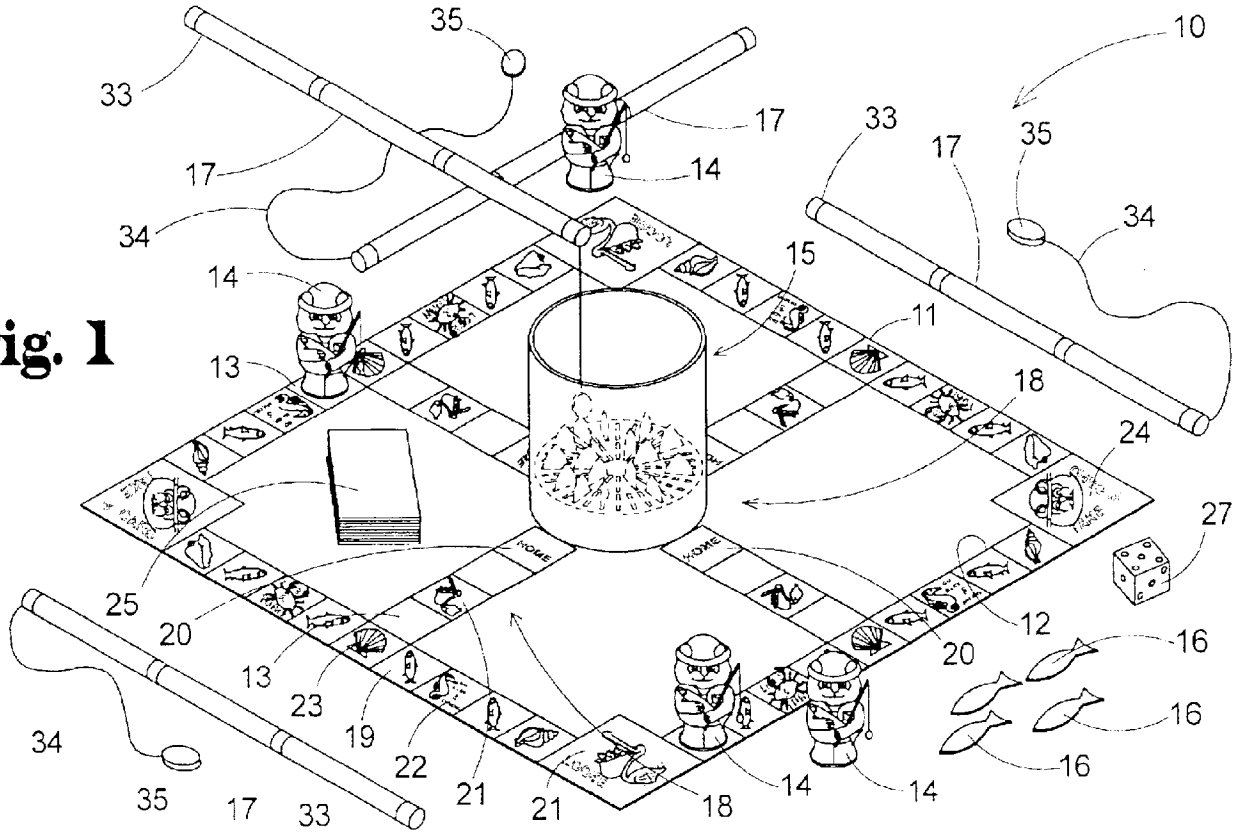
FIG. 1 is a perspective view of a new game system according to the present invention.
Figure 2:
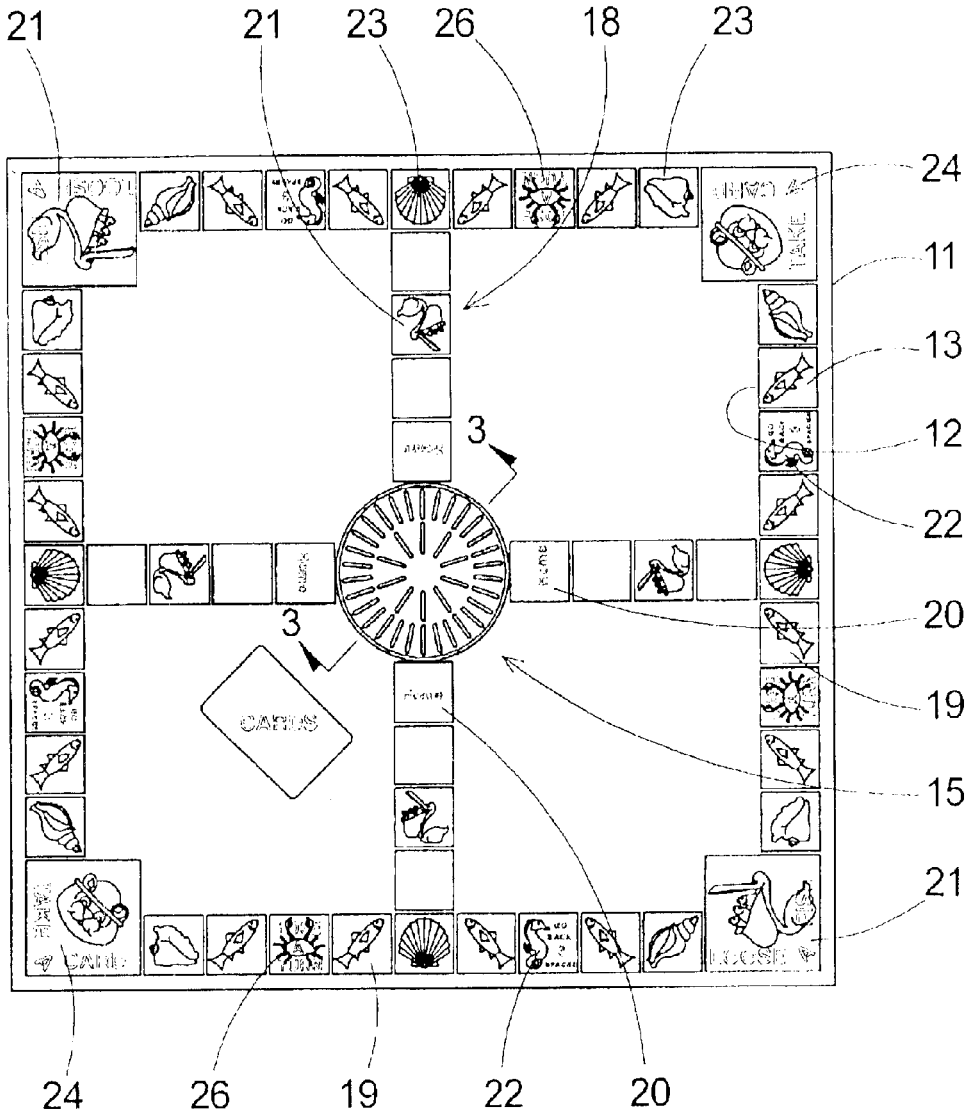
FIG. 2 is a top view of the present invention.
Figure 3:
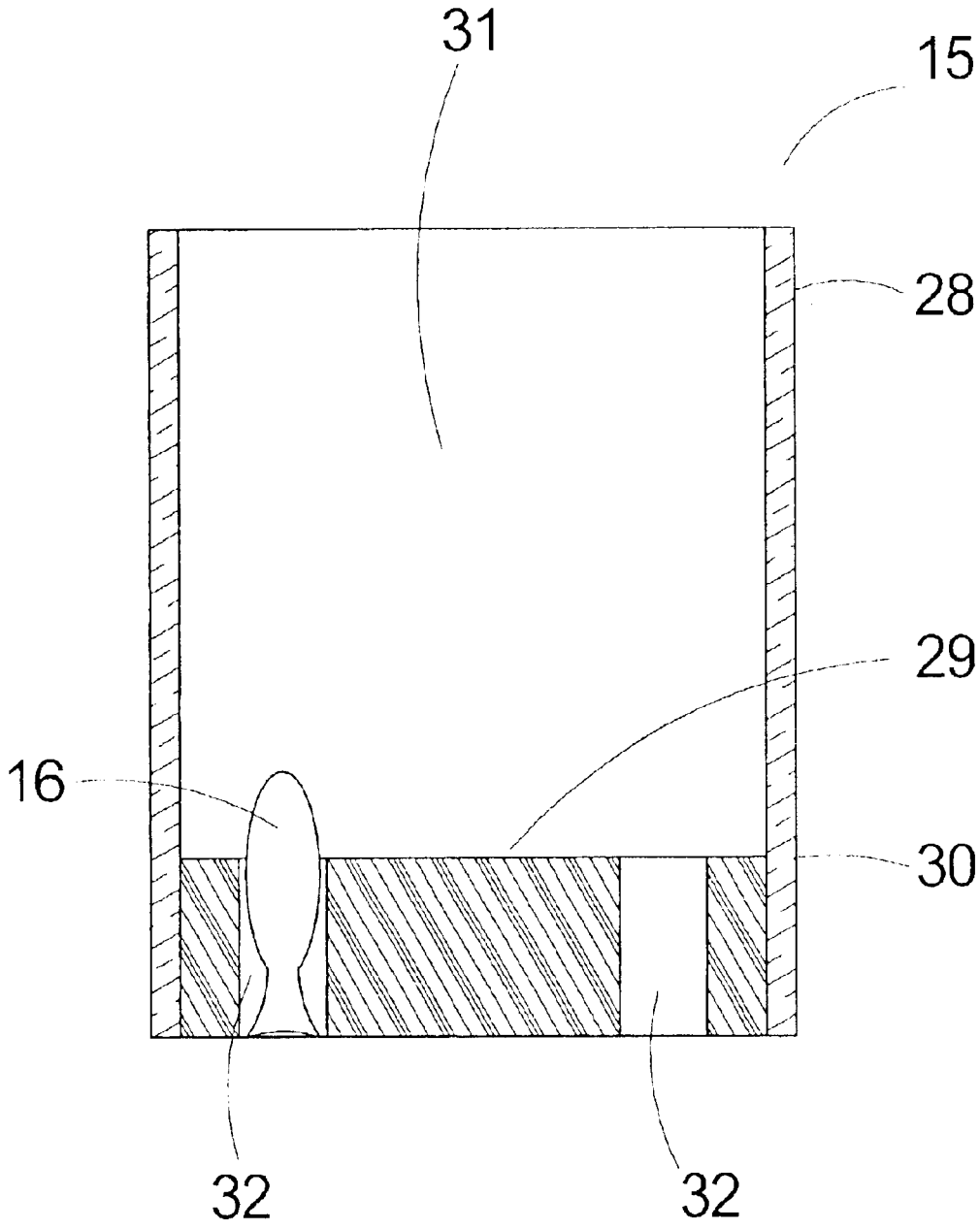
FIG. 3 is a cross-sectional view of the fish containment assembly of the present invention as taken along line 3—3 of FIG. 2.

With reference now to the drawings, and in particular to FIGS. 1 through 3 thereof, a new game system and method of playing embodying the principles and concepts of the present invention and generally designated by the reference numeral 10 will be described.

As best illustrated in FIGS. 1 through 3, the game system 10 generally comprises a game board 11 being designed for being positioned on a support surface.

A playing path 12 is positioned on the game board 11. The playing path 12 is comprised of a plurality of play spaces 13.

A plurality of player tokens 14 are placed one the playing path 12. Each of the players tokens is designed for being selected by one of the players whereby each of the player tokens 14 is for representing the place of the associated one of the players on the playing path 12. Each of the player tokens 14 may be shaped like bears to provide a pleasing appearance to younger players.

A fish containment assembly 15 is operationally coupled to the game board 11. The fish containment assembly 15 selectively contains a plurality of fish members 16.

Each of a plurality of retrieval members 17 is designed for being gripped in a hand of the player. Each of the retrieval members 17 is for retrieving one of the fish members 16 from the fish containment assembly 15 when one of the player tokens 14 of an associated one of the players is placed on a portion of the play spaces 13 of the playing path 12.

The play spaces 13 comprise a plurality of sets of play spaces 18. Each of the sets of play spaces 18 comprises a unique color. Each of the sets of play spaces 18 is associated with one of the player tokens 14.

Each of the player tokens 14 comprises a unique color matching one of the unique colors of one of the sets of play spaces 18. Each of the player tokens 14 is designed for representing the associated one of the players.

The plurality of play spaces 13 comprise a plurality of fishing spaces 19. Each of the fishing spaces 19 comprises one of the unique colors of the sets of play spaces 18. Each of the fishing spaces 19 is designed for indicating one of the fish members 16 of the same color be removed from the fish containment assembly 15 by one of the players using one of the retrieval members 17 when the associated one of the players tokens is positioned on one of the fishing spaces 19.

Each of the sets of play spaces 18 comprises a start space 20. The start space 20 of the associated one of the sets of play spaces 18 indicates a start and end for an associated one of the player tokens 14.

The play spaces 13 comprise a plurality of return spaces 21. Each of the return spaces 21 is designed for indicating one of the players is to return one the fish members 16 retrieved by the associated one of the players to the fish containment assembly 15 when the associated one of the player tokens 14 is positioned on one of the return spaces 21.

The play spaces 13 comprise a plurality of movement spaces 22. Each of the movement spaces 22 is designed for indicating one of the players move the associated one of the player tokens 14 back along the path a predetermined number of the play spaces 13 when the associated one of the player tokens 14 is positioned on one of the movement spaces 22.

The play spaces 13 comprise a plurality of termination spaces 23. Each of the termination spaces 23 is designed for indicating an end of the turn for one of the players when the associated one of the players tokens is positioned on one of the termination spaces 23.

The play spaces 13 comprises a plurality of card spaces 24. Each of the card spaces 24 directs drawing one of a plurality of cards 25 by one of the players and performing an action as directed by the drawn one of the cards 25 when the associated one of the player tokens 14 is positioned on one of the card spaces 24. Each of the cards 25 may have directions similar to those listed below.

1. Fish too small throw one back
2. Crab broke your line lose one turn
3. Blue Bear lose one fish
4. Yellow Bear lose one fish
5. Green Bear lose one fish
6. Red Bear lose one fish
7. Share one fish with Yellow Bear
8. Share one fish with Blue Bear
9. Share one fish with Green Bear
10. Share one fish with Red Bear
11. Yellow Bear go fish
12. Blue Bear go fish
13. Green Bear go fish
14. Red Bear go fish
15. Go Back four Spaces
16. Go forward two spaces
17. Go fish
18. You found one worm go fishing
19. You found two worms go fishing twice
20. You caught a turtle, lose a turn The play spaces 13 comprises a plurality of turn spaces 26. Each of the turn spaces 26 is designed for indicating to one of the players to cease the associated one of the players current turn and skip the associated one of the players next turn when the associated one of the player tokens 14 is positioned on one of the turn space.

At least one die 27 is designed for being rolled by each of the players in turn. The die 27 comprises a plurality of number indicia whereby each of the number indicia is for indicating the number of play spaces 13 the associated one of the player tokens 14 is moved along the path when the associated one of the players rolls the die 27.

The fish containment assembly 15 comprises a sleeve member 28 and base member 29. The base member 29 is positioned in the sleeve member 28. The base member 29 selectively engages the fish members 16 whereby the base member 29 supports the fish members 16 in the sleeve member 28. Each of the retrieval members 17 is inserted into the sleeve member 28 for removing one of the fish members 16.

The sleeve member 28 comprises a perimeter wall 30. The perimeter wall 30 defines a bore 31 of the sleeve member 28 whereby the bore 31 extends through the sleeve member 28. The bore 31 of the sleeve member 28 receives the base member 29 whereby the fish members 16 are positioned in the bore 31 of the sleeve member 28.

The base member 29 comprises a plurality of slots 32. Each of the slots 32 extends into the base member 29. Each of the slots 32 selectively receives one of the fish members 16 whereby each of the fish members 16 extends from the base member 29 to be retrieved by one of the retrieval members 17.

Each of the retrieval members 17 comprises a pole portion 33, a string portion 34 and a retrieving portion 35. The string portion 34 is coupled to the pole portion 33 whereby the retrieving portion 35 is coupled to the string portion 34 opposite the pole portion 33. The retrieving portion 35 selectively engages at least one of the fish members 16 in the fish containment assembly 15 to allow the pole portion 33 to be used to remove the associated one of the fish members 16 from the fish containment assembly 15 when the retrieving portion 35 is inserted into the fish containment assembly 15.

The retrieving portion 35 of each of the retrieval members 17 comprises a magnet. The magnet of each of the retrieval members 17 is magnetically couplable to one of the fish member to facilitate removal of the associated one of the fish members 16 from the fish containment assembly 15.

In use, each of the players chooses one of the player tokens 14 and the retrieval members 17. The associated one of the player tokens 14 is paced on the start space 20 of the associated one of the sets of play spaces 18 comprising the same color as the associated one of the player tokens 14. The die 27 is rolled by each of the players in turn and moving of the associated one of the player tokens 14 a number of the play spaces 13 matching the number indicia indicated on the die 27. The retrieving portion 35 of the associated one of the retrieval members 17 is placed into the sleeve member 28 to retrieve one of the fish members 16 from the base member 29 of the fish containment assembly 15 when the associated one of the players positions their associated one of the player tokens 14 on one of the fishing spaces 19. The retrieved one of the fish members 16 is returned by the associated one of the players to the fish containment assembly 15 when the retrieved one of the fish members 16 does not match the color of the associated one of the fishing spaces 19 occupied by the associate one of the player tokens 14. The die 27 is rolled again by the associated one of the players when the associated one of the players successfully retrieves one of the fish members 16 from the fish containment assembly 15 when the fish member matches the color of the fishing space. One of the fish members 16 retrieved by the associated one of the players is returned to the fish containment assembly 15 when the associated one of the player tokens 14 is positioned on one of the return spaces 21. One of the cards 25 is drawn and the action described on the associated one of the cards 25 is performed by one of the players when the associated one of the player tokens 14 is positioned on one of the card spaces 24. One of the player tokens 14 is moved back a predetermined number of play spaces 13 when the associated one of the players places the associated one of the player tokens 14 on one of the movement spaces 22. One of the players losing their next turn when the associated one of the player tokens 14 is positioned on one of the turn spaces 26. One of the players turns ending when the associated one of the player tokens 14 is positioned on one of the termination spaces 23. The game is won by one of the players when the associated one of the player tokens 14 is returned along the path to the start space 20 of the associated one of the sets of play spaces 18 and a predetermined number of the fish members 16 removed from the fish containment assembly 15.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A board game system for providing entertainment to a plurality of players, the board game system comprising:

a game board being adapted for being positioned on it support surface;

a playing path being positioned on said game board, said playing path being comprised of a plurality of play spaces;

a plurality of player tokens being placed one said playing path, each of said players tokens being adapted for being selected by one of the players such that each of the player tokens is for representing the place of the associated one of the players on said playing path;

a fish containment assembly being operationally coupled to said game board, a plurality of fishlike token members being selectively positioned in said fish containment assembly;

each of a plurality of retrieval members being adapted for being gripped in a band of the player, each of said retrieval members being for retrieving one of said fish members from said fish containment assembly when one of said player tokens of an associated one of the players is placed on a portion of said play spaces of said playing path; and said fish containment assembly comprising a sleeve member and base member, said base member being positioned in said sleeve member, said base member selectively engaging said fish members such that said base member supports said fish members in said sleeve member, each of said retrieval members being inserted into said sleeve member for removing one of said fish members, said sleeve member having a height greater than a diameter and height of said base member to inhibit visibility of said fish members engaged by said base member for inhibiting identification of said fish members by the associated one of the players when one of said retrieval members is used to retrieve one of said fish members by the associated one of the players.

2. The board game system as set forth in claim 1, further comprising:

said play spaces comprising a plurality of sets of play spaces, each of said sets of play spaces comprising a unique color, each of said sets of play spaces being associated with one of said player tokens.

3. The board game system as set forth in claim 2, further comprising:

each of said player tokens comprising a unique color matching one of the unique colors of one of said sets of play spaces, each of said player tokens being adapted for representing the associated one of the players.

4. The board game system as set forth in claim 2, further comprising:

said plurality of play spaces comprising a plurality of fishing spaces, each of said fishing spaces comprising one of the unique colors of said sets of play spaces, each of said fishing spaces being adapted for indicating one of said fish members of the same color be removed from said fish containment assembly by one of the players using one of said retrieval members when the associated one of said players tokens is positioned on one of said fishing spaces.

5. The board game system as set forth in claim 2, further comprising:

each of said sets of play spaces comprising a start space, said start space of the associated one of said sets of play spaces indicating a start and end for an associated one of the player tokens.

6. The board game system as set forth in claim 1, further comprising:

said play spaces comprising a plurality of return spaces, each of said return spaces being adapted for indicating one of the players is to return one said fish members retrieved by the associated one of the players to said fish containment assembly when the associated one of said player tokens is positioned on one of said return spaces.

7. The board game system as set forth in claim 1, further comprising:

said play spaces comprising a plurality of movement spaces, each of said movement spaces being adapted for indicating one of the players move the associated one of said player tokens back along said path a predetermined number of said play spaces when the associated one of said player tokens is positioned on one of said movement spaces.

8. The board game system as set forth in claim 1, further comprising:

said play spaces comprising a plurality of termination spaces, each of said termination spaces being adapted for indicating an end of the turn for one of the players when the associated one of the players tokens is positioned on one of said termination spaces.

9. The board game system as set forth in claim 1, further comprising:

said play spaces comprising a plurality of card spaces, each of said card spaces directing drawing one of a plurality of cards by one of the players and performing an action as directed by the drawn one of said cards when the associated one of said player tokens is positioned on one of said card spaces.

10. The board game system as set forth in claim 1, further comprising:

said play spaces comprising a plurality of turn spaces, each of said turn spaces being designed for indicating to one of the players to cease the associated one of the players current turn and skip the associated one of the players next turn when the associated one of the player tokens is positioned on one of said turn space.

11. The board game system as set forth in claim 1, further comprising:

at least one die being adapted for being rolled by each of the players in turn, said die comprising a plurality of number indicia such that each of said number indicia is for indicating the number of play spaces the associated one of the player tokens is moved along the path when the associated one of the players rolls said die.

12. The board game system as set forth in claim 1, further comprising:

said sleeve member comprising a perimeter wall, said perimeter wall defining a bore of said sleeve member such that said bore extends through said sleeve member, said bore of said sleeve member receiving said base member such that said fish members are positioned in said bore of said sleeve member.

13. The board game system as set forth in claim 1, further comprising:

said base member comprising a plurality of slots, each of said slots extending into said base member, each of said slots selectively receiving one of said fish members such that each of said fish members extends from said base member to be retrieved by one of said retrieval members.

14. The board game system as set forth in claim 1, further comprising:

each of said retrieval members comprising a pole portion, a string portion and a retrieving portion, said string portion being coupled to said pole portion such that said retrieving portion is coupled to said string portion opposite said pole portion, said retrieving portion selectively engaging at least one of said fish members in said fish containment assembly to allow said pole portion to be used to remove the associated one of said fish members from said fish containment assembly when said retrieving portion is inserted into said fish containment assembly.

15. The board game system as set forth in claim 1, further comprising:

said retrieving portion of each of said retrieval members comprising a magnet, said magnet of each of said retrieval members being magnetically couplable to one of said fish member to facilitate removal of the associated one of said fish members from said fish containment assembly.

16. A method playing a game comprising:

a game system comprising:

a game board being adapted for being positioned on a support surface;

a playing path being positioned on said game board, said playing path being comprised of a plurality of play spaces;

a plurality of player tokens being placed one said playing path, each of said players tokens being adapted for being selected by one of the players such that each of the player tokens is for representing the place of the associated one of the players on said playing path;

a fish containment assembly being operationally coupled to said game board, a plurality of fishlike token members being selectively positioned in said fish containment assembly;

each of a plurality of retrieval members being adapted for being gripped in a hand of the player, each of said retrieval members being for retrieving one of said fish members from said fish containment assembly when one of said player tokens of an associated one of the players is placed on a portion of said play spaces of said playing path;

said play spaces comprising a plurality of sets of play spaces, each of said sets of play spaces comprising a unique color, each of said sets of play spaces being associated with one of said player tokens;

each of said player tokens comprising a unique color matching one of the unique colors of one of said sets of play spaces, each of said player tokens being adapted for representing the associated one of the players;

said plurality of play spaces comprising a plurality of fishing spaces, each of said fishing spaces comprising one of the unique colors of said sets of play spaces, each of said fishing spaces being adapted for indicating one of said fish members of the same color be removed from said fish containment assembly by one of the players using one of said retrieval members when the associated one of said players tokens is positioned on one of said fishing spaces;

each of said sets of play spaces comprising a start space, said start space of the associated one of said sets of play spaces indicating a start and end for an associated one of the player tokens;

said play spaces comprising a plurality of return spaces, each of said return spaces being adapted for indicating one of the players is to return one said fish members retrieved by the associated one of the players to said fish containment assembly when the associated one of said player tokens is positioned on one of said return spaces;

said play spaces comprising a plurality of movement spaces, each of said movement spaces being adapted for indicating one of the players move the associated one of said player tokens back along said path a predetermined number of said play spaces when the associated one of said player tokens is positioned on one of said movement spaces;

said play spaces comprising a plurality of termination spaces, each of said termination spaces being adapted for indicating an end of the turn for one of the players when the associated one of the players tokens is positioned on one of said termination spaces;

said play spaces comprising a plurality of card spaces, each of said card spaces directing drawing one of a plurality of cards by one of the players and performing an action as directed by the drawn one of said cards when the associated one of said player tokens is positioned on one of said card spaces;

said play spaces comprising a plurality of turn spaces, each of said turn spaces being designed for indicating to one of the players to cease the associated one of the players current turn and skip the associated one of the players next turn when the associated one of the player tokens is positioned on one of said turn space;

at least one die being adapted for being rolled by each of the players in turn, said die comprising a plurality of number indicia such that each of said number indicia is for indicating the number of play spaces the associated one of the player tokens is moved along the path when the associated one of the players rolls said die;

said fish containment assembly comprising a sleeve member and base member, said base member being positioned in said sleeve member, said base member selectively engaging said fish members such that said base member supports said fish members in said sleeve member, each of said retrieval members being inserted into said sleeve member for removing one of said fish members, said sleeve member having a height greater than a diameter and height of said base member to inhibit visibility of paid fish members engaged by said base member for inhibiting identification of said fish members by the associated one of the players when one of said retrieval members is used to retrieve one of said fish members by the associated one of the players;

said sleeve member comprising a perimeter wall, said perimeter wall defining a bore of said sleeve member such that said bore extends through said sleeve member, said bore of said sleeve member receiving said base member such that said fish members are positioned in said bore of said sleeve member;

said base member comprising a plurality of slots, each of said slots extending into said base member, each of said slots selectively receiving one of said fish members such that each of said fish members extends from said base member to be retrieved by one of said retrieval members;

each of said retrieval members comprising a pole portion, a string portion and a retrieving portion, said string portion being coupled to said pole portion such that said retrieving portion is coupled to said string portion opposite said pole portion, said retrieving portion selectively engaging at least one of said fish members in said fish containment assembly to allow said pole portion to be used to remove the associated one of said fish members from said fish containment assembly when said retrieving portion is inserted into said fish containment assembly;

said retrieving portion of each of said retrieval members comprising a magnet, said magnet of each of said retrieval members being magnetically couplable to one of said fish member to facilitate removal of the associated one of said fish members from said fish containment assembly;

choosing of one of said player tokens and said retrieval members by each of said players;

placing the associated one of said player tokens an said start space of the associated one of said sets of play spaces comprising the same color as the associated one of said player tokens;

rolling of said die by each of the players in turn and moving of the associated one of the player tokens a number of said play spaces matching said number indicia indicated on said die;

placing of said retrieving portion of the associated one of said retrieval members into said sleeve member to retrieve one of said fish members from said base member of said fish containment assembly when the associated one of the players positions there associated one of said player tokens on one of said fishing spaces;

returning one of said fish members by the associated one of the players to said fish containment assembly when the retrieved one of said fish members does not match the color of the associated one of said fishing spaces occupied by the associate one of said player tokens;

rolling of said die again by the associated one of the players when the associated one of the players successfully retrieves one of said fish members from said fish containment assembly when said fish member matches to color of said fishing space;

returning of one of said fish members retrieved by the associated one of the players to said fish containment assembly when the associated one of said tokens is positioned on one of said return spaces;

drawing of one of said cards and performing the action described on the associated one of said cards by one of the players when the associated one of said player tokens is positioned on one of said card spaces; and winning of the game by one of the players when the associated one of the player tokens is returned along said path to said start space of the associated one of said sets of play spaces and predetermined number of said fish members removed from said fish containment assembly.

17. The method as set forth in claim 16, further comprising:

moving back of one of said player tokens a predetermined number of play spaces when the associated one of the players places the associated one of said player tokens on one of said movement spaces.

18. The method as set forth in claim 16, further comprising:

losing of a next turn by one of the players when the associated one of said player tokens is positioned on one of said turn spaces.

19. The method as set forth in claim 16, further comprising:

ending of one of the players turns when the associated one of the player tokens is positioned on one of said termination spaces.

* * * * *